US005624384A

United States Patent [19]

Chen

[11] Patent Number: 5,624,384

[45] Date of Patent: Apr. 29, 1997

[54] JADE MADE MASSAGE-ROD

[75] Inventor: Liu-Kin Chen, Taipei, Taiwan

[73] Assignee: IMEI Chemical Enterprise Ltd., Taipei, Taiwan

[21] Appl. No.: 434,865

[22] Filed: May 4, 1995

[51] Int. Cl.[6] ..... A61H 15/00

[52] U.S. Cl. ..... 601/84; 601/107; 601/135; 601/137

[58] Field of Search ..... 601/107, 108, 601/84, 133–137; 606/238, 201, 204, 204.35

[56] References Cited

U.S. PATENT DOCUMENTS

| | | | |
|---|---|---|---|
| D. 85,076 | 9/1931 | Barker | 601/137 X |
| 1,212,443 | 1/1917 | Blaine | 601/137 |
| 1,443,725 | 1/1923 | Bonanno | 606/204.15 |
| 1,724,842 | 8/1929 | Kazmazyk | 601/137 |
| 1,815,560 | 7/1931 | Gehm | 601/138 |
| 1,965,861 | 7/1934 | Schneider | 601/137 X |
| 3,590,821 | 7/1971 | Orlandini | 601/120 X |

FOREIGN PATENT DOCUMENTS

| | | | |
|---|---|---|---|
| 1299582 | 3/1987 | U.S.S.R. | 601/84 |

OTHER PUBLICATIONS

"Balancing Life's Energy, Fresno Chiropractors, Studies the Yin, Yang of Chinese Medicine", Lopez, Fresno Bee, (May 4, 1990).

"Profiting off the New Age from Crystals to Channeling, An Explosion/New Businesses", Carton, Boston Globe, Jul. 5, 1988.

"Pain Erasure", Bonnie Prudden, (Pamphlet)—Bondos, 1994.

*Primary Examiner*—Danton D. DeMille
*Attorney, Agent, or Firm*—Bacon & Thomas

[57] ABSTRACT

A massage rod, particularly a jade made massage rod, having an umbrella shaped head and a round rod attached to the head. The umbrella shaped head is designed to massage the head and face of human beings. The round rod is designed to massage the vital points of veins and arteries of the human body. This invention can improve the movement of veins and arteries of human beings so as to make the complexion more beautiful.

2 Claims, 7 Drawing Sheets

JADE MADE MASSAGE-ROD

BACKGROUND OF THE INVENTION

This present invention relates to a massage-rod, it particularly relates to a rod made of jade for massaging the veins and arteries of the human body so as to make the complexion more beautiful.

Vein and artery are the general names of vein vessels and artery vessels which connect with each other just like a net under the skin of the human body. FIG. 1 shows the system of veins and arteries.

The veins and arteries system of the human body have a very fine mutual action of adjustment. Having the veins and arteries massaged is one of the best ways to transport blood in order to beautify the complexion of the human body, and jade is the best material for massaging veins and arteries. Therefore, the inventor of the present invention provides a JADE MADE MASSAGE ROD in view of the final quality and the smooth surface of the jade which can be used to make the complexion more beautiful.

SUMMARY OF THE INVENTION

The JADE MADE MASSAGE ROD is made of very fine jade with an umbrella shaped big head. Under the umbrella shaped head, there is a round rod comparatively smaller in diameter and a square shaped jade plate bigger than the round rod and smaller than the umbrella shaped head between the umbrella head and the round rod for connecting the umbrella head with the rod. It is very smooth on the margin of the umbrella head and the end of the round rod.

The umbrella shaped head can be used to massage the complexion of the face, the round rod can be used to massage vital points of veins and arteries of our human body, so the purpose of thrilling the veins and the arteries is achieved.

The present invention is a new product with small size, which is easy to use, convenient to carry along, and involves nothing about energy, electricity or any other attachments. It is really a product of convenience and good quality.

DETAILED DESCRIPTION OF THE PREFERRED EMBODIMENTS

Figure 1:
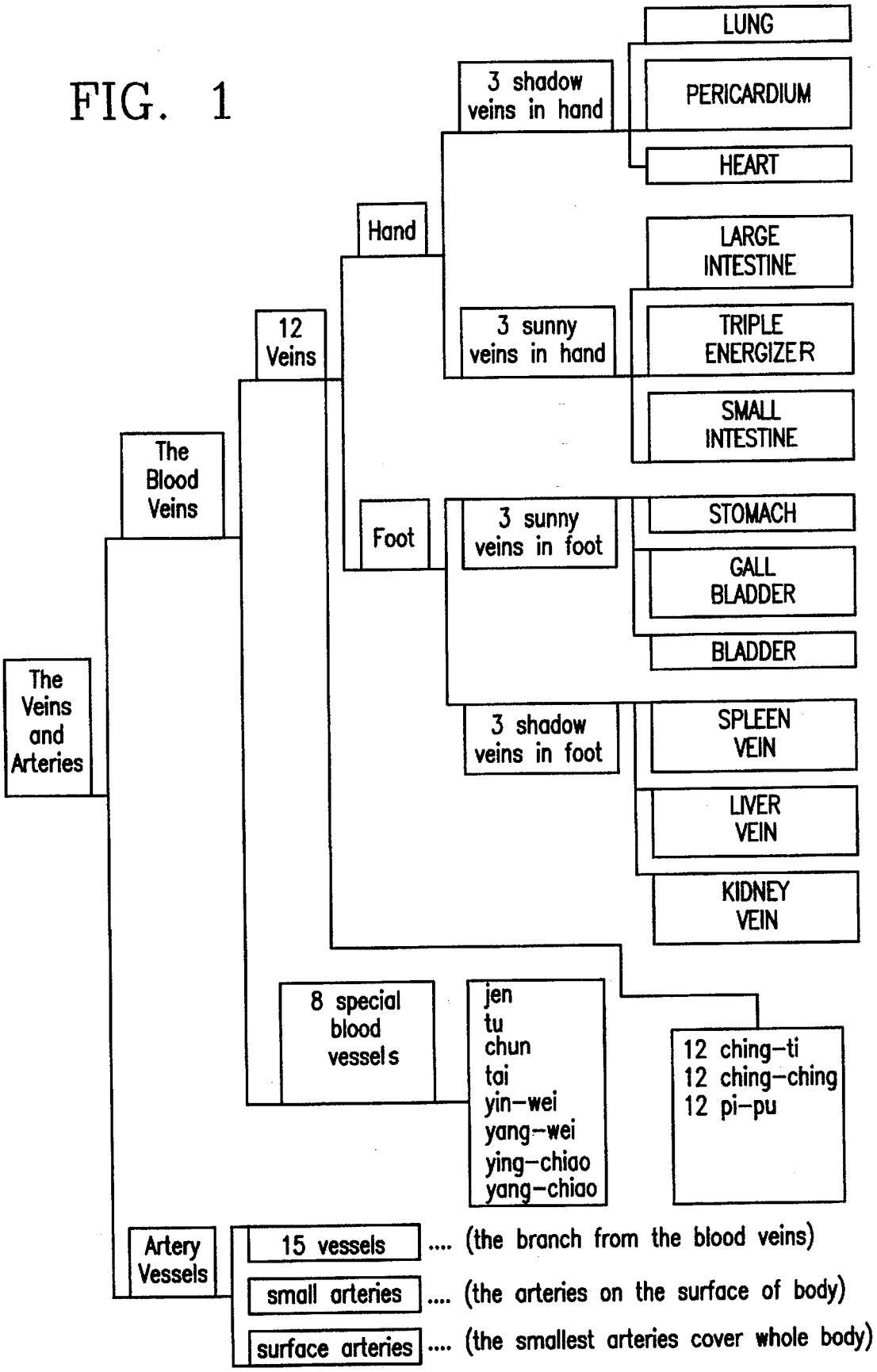
FIG. 1 is a diagram illustrating the system of veins and arteries of the human body.
Figure 2:
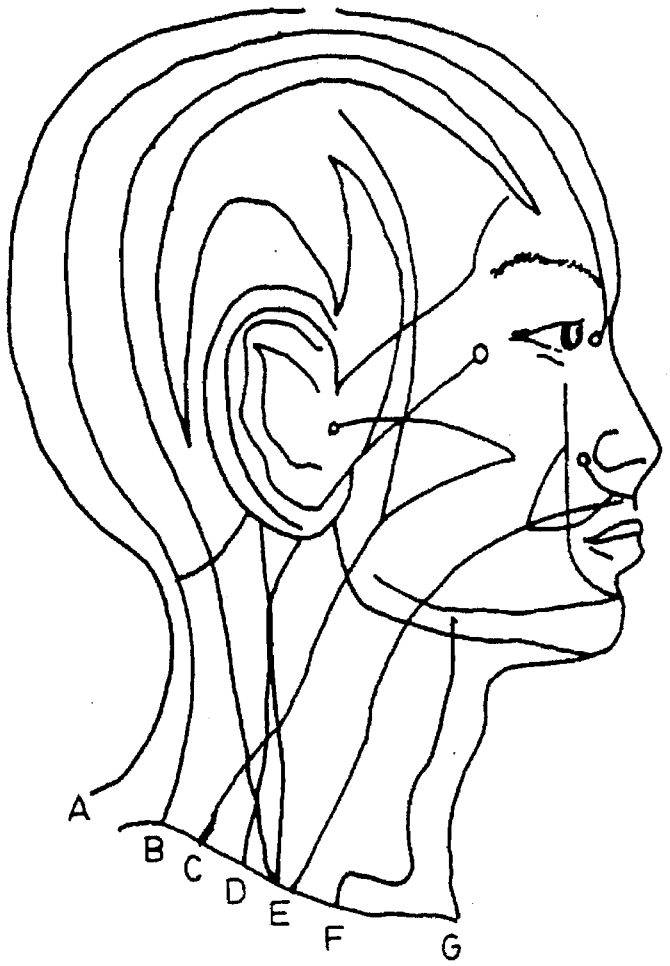
FIG. 2 shows the system of veins and arteries on the head and face of human beings.
Figure 3:
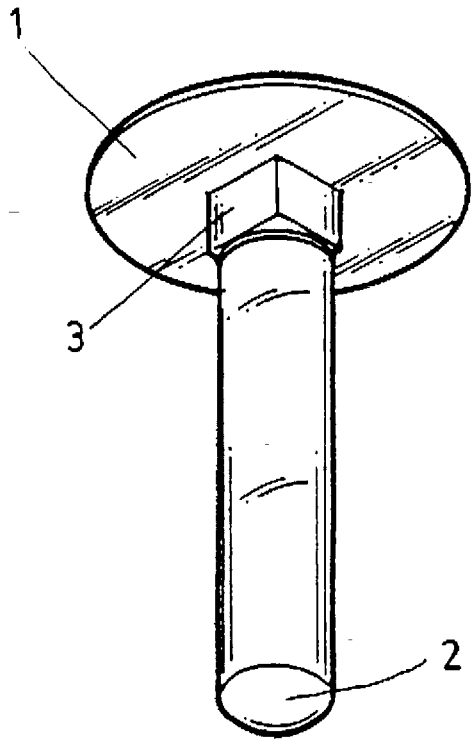
FIG. 3 is a perspective view showing the overall shape of the present invention.
Figure 4:
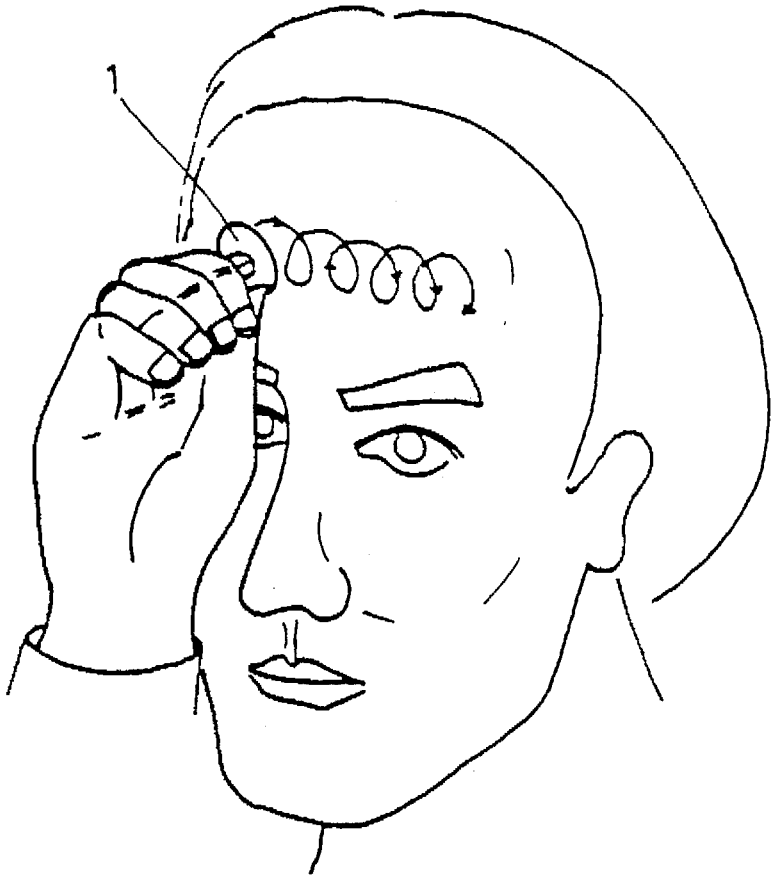
FIG. 4 shows massaging the forehead using the present invention.
Figure 6:
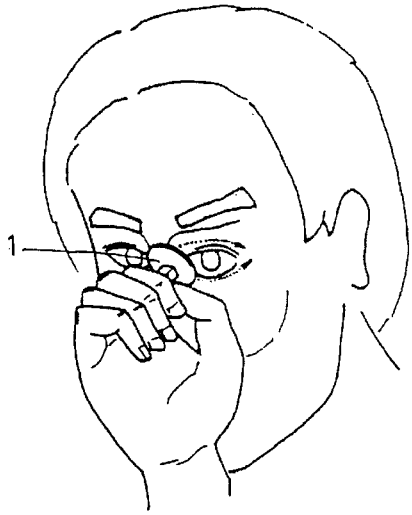
FIG. 6 shows massaging around the eyes.

The present invention is relates to JADE MADE MASSAGE ROD, as shown in FIG. 3. This invention is made of jade designed with a big umbrella shaped head (1) and round rod (2) connected with the head (1). There is a square plate (3) between the head (1) and the rod (2) to attach the head (1) and the rod (2) to each other. Both the margin of the umbrella head (1) and the end of the rod (2) are curved smoothly so as to have a fine surface that will make the complexion feel comfortable during massage. How massages should be carried on are described hereinafter:

I. Using big head (1) to massage:

Wherever the parts of the face are to be massaged, one has to use the big head (1) to massage slowly, lightly and steadily, as shown in FIG. 4. When one massages around the eyes, one should move the big head (1) slowly from the rood of the nose in a circle around the eye and repeat it for three times, just as shown in FIG. 6.

Figure 5:
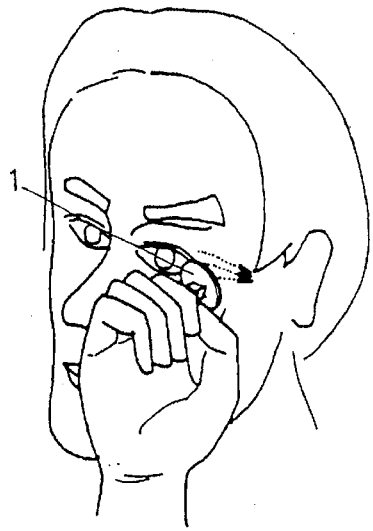
FIG. 5 shows massaging on the comer of the eyes.
Figure 7:
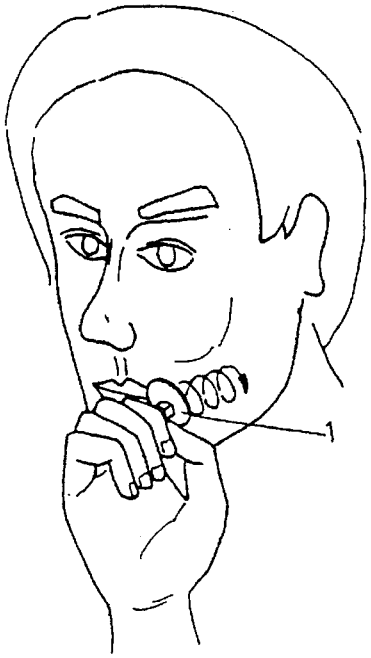
FIG. 7 shows massaging on both sides of the mouth.
Figure 8:
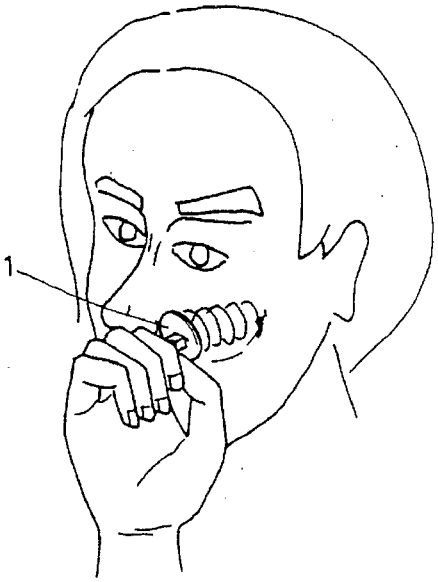
FIG. 8 shows massaging on cheek bones.
Figure 9:
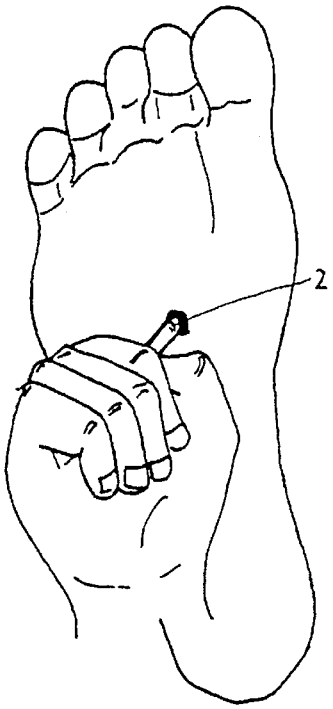
FIG. 9 shows massaging on the bottom of a foot.

When one massages the comers of the eyes, one should slightly press the big head (1) on the outer comer of eyes and move it steadily to the root of the hair and repeat it for three times, just as shown in FIG. 5. When one massages the comer of the mouth, one should slightly press the big head (1) on both an upper and a bottom portion of the mount or both comers of the mouth and move toward the bottom of the chin for three times, just as shown in FIG. 7.

II. Using round rod (2) to massage:

When one intends to massage the bottom of the foot, one should heavily press the round rod (2) on the spot intended to be massaged and move the rod rightwards and leftwards for 5 to 10 minutes.

Figure 10:
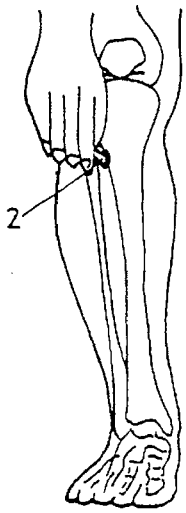
FIGS. 10 to 16 show massaging the vital points of the veins and arteries in the human body.

When one's face turns to yellow, it means that one's appetite and stomach are not good so that nutrition cannot be absorbed. Therefore, one should press the round rod (2) on the vital point named SAN-LI for improvement, as shown in FIG. 10.

Figure 11:
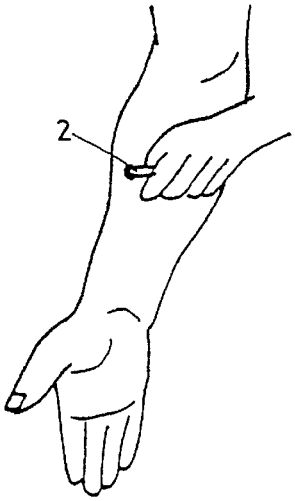

When ones's face turns to red, it means that one's inside fever is too high to endure. Once can press the round rod (2) on the vital point named KUNG-TSUI so as to reduce the fever as shown in FIG. 11.

Figure 12:
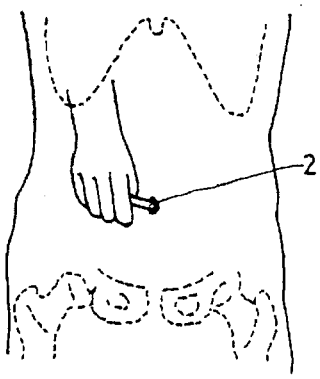

When one's face turns to white, it means one's veins and arteries are abnormal and cold inside is increasing. One should press the round rod (2) on vital points named KUANYUAN and CHI-HAI for increasing the inside fever to normal, as shown in FIG. 12.

Figure 13:
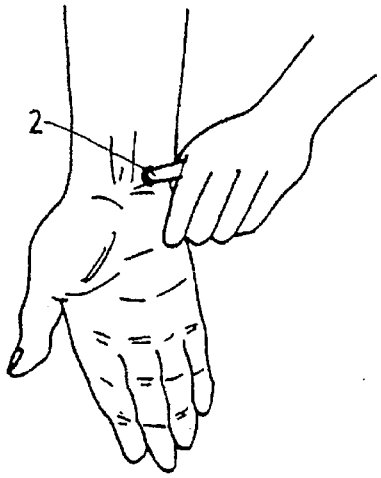
Figure 14:
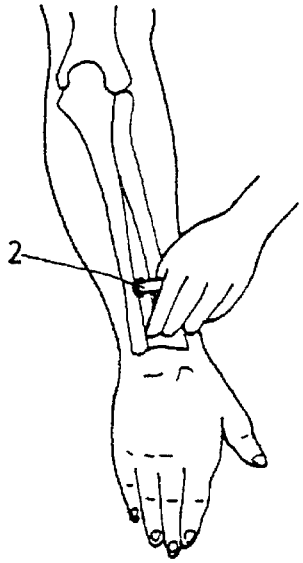
Figure 15:
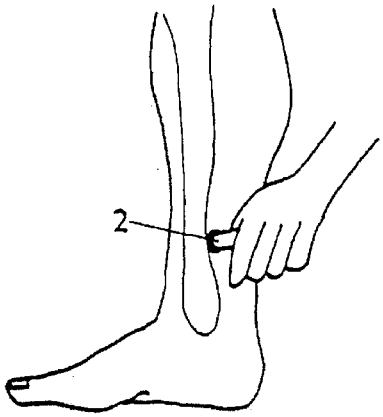

When one's face turns dark, it means that one's kidney is no good. One should press the round rod (2) on the vital point named YOUNG-CHUN so as to return it to normal, as shown in FIG. 13. When one's eyes-circuit turns to blue, it means that one has not had good sleep for a long time. One should press the round rod (2) on the vital point named SHENG-MEN for having normal sleep.

When one's face swells in the early morning, it means that one's veins and arteries in the spleen are abnormal. One should press the round rod (2) on vital point named SAN-YANG for turning back to normal.

Figure 16:
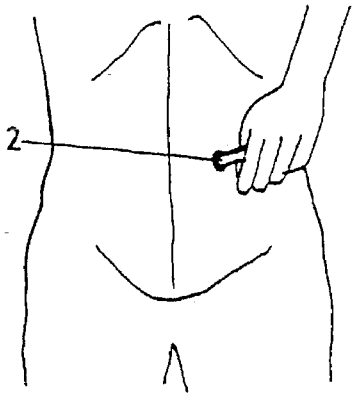

When one's face grows with more grog-blossoms, it means that one's stomach movement is not goods. One should press round rod (2) on the vital point named TIEN-O for back to normal, as shown in FIG. 16.

What is claimed is:

1. A jade massage rod comprising:

a) a first massaging portion having a substantially circular configuration, a convex massaging surface and a second surface; and, b) a substantially cylindrical second massaging portion extending from the second surface of the first massag ing portion and having a curved distal massaging end, a diameter of the cylindrical second massaging portion being less than a diameter of the circular first massaging portion, wherein said massage rod is formed as a single piece of jade.

2. The jade massage rod in claim 1 further comprising a plate having a square cross-sectional configuration and located between the first massaging portion and the second massaging portion.

* * * * *